US005241331A

United States Patent [19]

Chiku

[11] Patent Number: 5,241,331

[45] Date of Patent: Aug. 31, 1993

[54] SHEET CONVEYOR APPARATUS WITH SLIP TRANSMISSION

[75] Inventor: Kazuyoshi Chiku, Yokohama, Japan

[73] Assignee: Canon Kabushiki Kaisha, Tokyo, Japan

[21] Appl. No.: 707,104

[22] Filed: May 29, 1991

[30] Foreign Application Priority Data

May 30, 1990 [JP] Japan ..... 2-142892

[51] Int. Cl.[5] ..... B41J 13/02; B41J 15/04; B65H 5/06

[52] U.S. Cl. ..... 346/134; 271/272; 346/136; 400/625; 400/636; 400/636.2

[58] Field of Search ..... 346/134, 136; 271/272-274, 270, 314, 176; 400/618, 634, 636, 636.2, 625, 641

[56] References Cited

U.S. PATENT DOCUMENTS

| | | | |
|---|---|---|---|
| 4,344,590 | 8/1982 | Dean | 346/136 X |
| 4,581,618 | 4/1986 | Watanabe et al. | 346/134 |
| 4,767,114 | 8/1988 | Nishimoto | 271/314 X |
| 5,000,439 | 3/1991 | Yoshizawa | 271/274 |
| 5,019,840 | 5/1991 | Watanabe et al. | 346/134 |

FOREIGN PATENT DOCUMENTS

| | | | |
|---|---|---|---|
| 0275943 | 11/1987 | Japan | 271/272 |
| 0158539 | 6/1990 | Japan | 271/272 |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A sheet conveyor apparatus is provided with a first rotator for supplying the feeding force to a sheet in contact with the sheet, a second rotator for supplying the feeding force to the sheet in contact with the sheet and from the opposite side of the sheet, a drive rotator rotatable by the drive force from a drive source, and a drive transmission for transmitting the drive force of the drive rotator to the second rotator so as to rotate the second rotator at a peripheral velocity higher than that of the first rotator. While the sheet is being conveyed, the drive transmission allows a slip as it transmits the drive force so that the second rotator can rotate at a peripheral velocity in conformance with that of the sheet.

29 Claims, 8 Drawing Sheets

FIG. 4 (1)
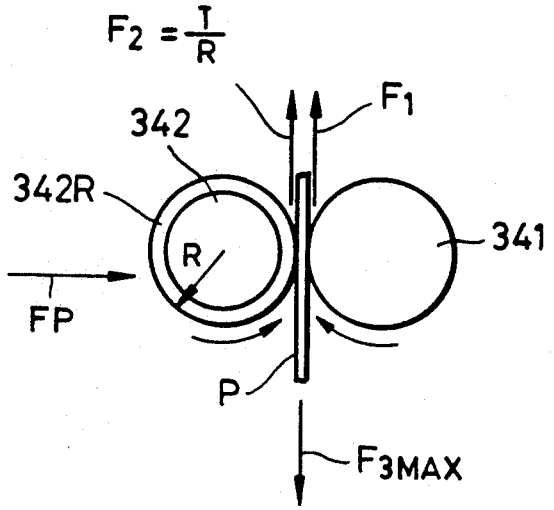
FIG. 4 (2)
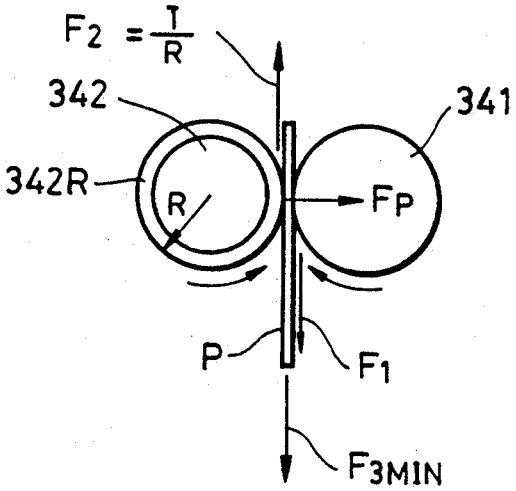

SHEET CONVEYOR APPARATUS WITH SLIP TRANSMISSION

BACKGROUND OF THE INVENTION

Field of the Invention

The present invention relates to a conveyor apparatus for conveying an image recording medium (sheet) in an image recording apparatus and the like.

Description of the Related Art

This kind of apparatus is provided with image recording media, such as papers, which are cut to a predetermined size and stacked, or in the form of a roll inside the apparatus or adjacent thereto.

A transport path for guiding the recording medium to an image recording position, and then to an eject position, is contained in the apparatus.

In the recording operation, the recording medium is guided along the transport path to the recording position whereupon an image is recorded on the recording medium and, then, the recording medium is ejected outside the apparatus.

In such an apparatus, the amount of movement of the recording medium during an image recording operation may vary in accordance with the feeding performance of a recording medium feeding device, such as a pair of rollers.

For example, if the surface of a feeding roller becomes worn after an increase of operating time, and its coefficient of friction is lowered, the amount of movement of the recording medium in a predetermined time or at a predetermined rotation angle of the feeding roller decreases and tends to vary.

The variance in the amount of movement of the recording medium leads to imaging failure, such as from an expansion or contraction of an image or from unevenness of the image density. For example, the differences in the movement speed will expand or contract an image in an apparatus which records the image by passing a recording medium through an image recording station. In other words, since the feeding speed is high when the feeding amount is large, the image is expanded, and since the feeding speed is low when the feeding amount is small, the image is contracted.

If the recording apparatus incorporates a serial printer wherein it stops movement of a recording medium after the recording medium is conveyed to a recording position, records and scans by a predetermined recording width, and then conveys the recording medium by the recording width so as to repeat a recording operation, other image quality problems may also occur. In this case, the recording medium is conveyed by rotating a feeding roller for a predetermined time or by a predetermined rotation angle after each recording and scanning operation, and the amount by which the recording medium conveys changes. Therefore, the recording medium is not conveyed by a predetermined amount and an uneven image is produced.

FIGS. 6(1) to 6(3) are views of images to explain the disadvantages of the prior art. FIG. 6(1) shows an image A which is recorded on a recording medium when the recording medium is conveyed by a normal amount. The recording width is designated by T and coincides with the feeding amount. The feeding direction of the recording medium is indicated by an arrow PD.

FIG. 6(2) shows an image A' that occurs when the feeding amount is small. As shown in FIG. 6(2), since the feeding amount T' is less than the recording width T in the image A', image laps t are formed at the ends of the recording width, and the image A' is not clear.

FIG. 6(3) shows an image A" that occurs when the feeding amount is too large. Since the feeding amount T' is greater than the recording width T in the image A", image gaps t' are formed at the ends of the recording width and the image A" is not clear.

An image recording apparatus which outputs a pictorial color image at a high precision of more than 100 dot/inch has been recently developed. In such a recording apparatus, it is known that an image is unclear if the image laps t and the image gaps t' are greater than several tens of μm.

In order to eliminate the differences in the conveying amount of the feed rollers, it has been suggested to make the coefficient of friction of the feeding roller higher and make the slip between the roller and the recording medium smaller. However, if an elastic material having a high coefficient of friction, such as rubber, is used as a material of a roller, although the coefficient of friction of the roller is made higher, it is difficult to precisely adjust the straightness, concentricity, run-out and so on of the roller, and the cost is greatly increased in order to obtain the above feeding precision of several tens of μm.

If an inelastic material, such as metal, is used for a roller, even if the surface of the roller is roughened by blast processing or the like, it is inevitable that the friction force of the roller will eventually weaken after extended use.

It has been suggested to increase the feeding force by increasing the nip pressure of a pair of feeding rollers to reduce slip between the rollers and the recording medium and thereby reduce differences in the feeding amount. However, if the nip pressure is increased, it is likely that the feeding direction of the recording medium will be shifted because the recording medium will be slantingly conveyed due to even a small deviation in the longitudinal balance of nip pressure of the rollers. In addition, other problems, such as incorrect feeding of the recording medium, distortion of the image, and wrinkling of the recording medium, may be caused.

Thus, there has never been any method capable of maintaining a high-precision feeding amount, that is, keeping differences in the feeding amount less than several tens of μm for extended periods of time.

SUMMARY OF THE INVENTION

With the above problems in view, an object of the present invention is to maintain a stable feeding amount of a recording medium through a long use of an image recording apparatus.

In one aspect of the invention, there is provided a sheet conveyor apparatus including a first rotator for supplying a feeding force to a sheet while in contact with a front surface of the sheet, a second rotator for supplying a feeding force to the sheet while in contact with a back surface of the sheet and a drive rotator rotatable by a drive force of a drive source. A drive transmission means transmits the driving force of the drive rotator to the second rotator so as to rotate the second rotator at a peripheral velocity higher than that of the first rotator and allow a slip of the second rotator sufficient to permit its peripheral velocity to conform to the feeding speed of the sheet when the sheet is being conveyed.

In a second aspect of the invention, there is provided a sheet conveyor apparatus including a first rotator for supplying a feeding force to a sheet by rotating in contact with the sheet and a second rotator for supplying a feeding force to the sheet while in contact with the sheet from an opposite side of said sheet as said first rotator. A drive rotator rotatable by a drive force of a drive source is provided, as is a torque limiter means for transmitting at least a portion of the rotation of the drive rotator to the second rotator.

In still another aspect of the invention, there is provided an image recording apparatus which incorporates the sheet conveyor apparatus of each aspect of the invention as summarized above.

BRIEF DESCRIPTION OF PREFERRED EMBODIMENT

Figure 5:
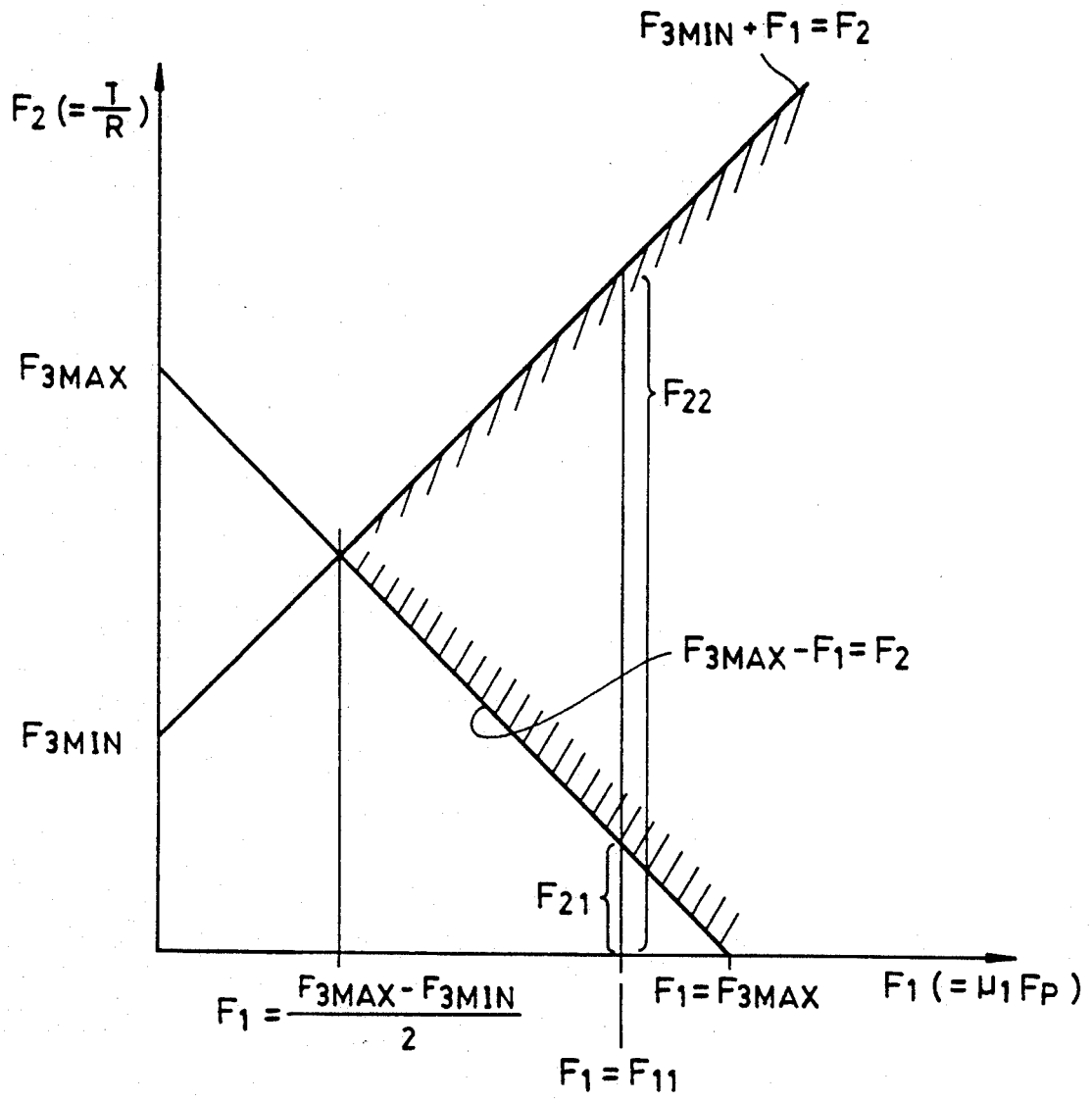
Figure 6:
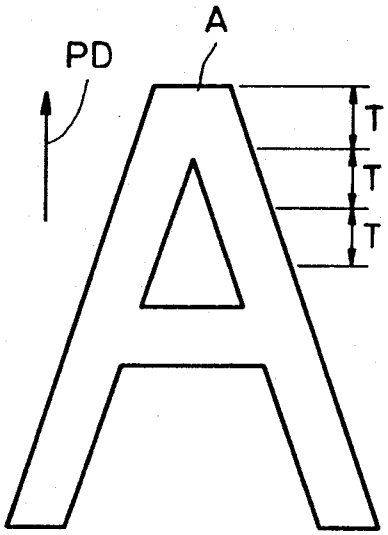
Figure 6:
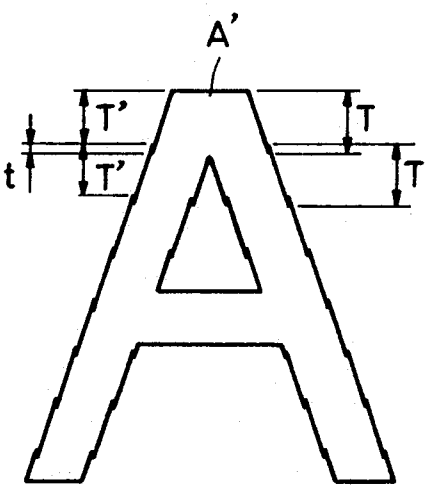
Figure 6:
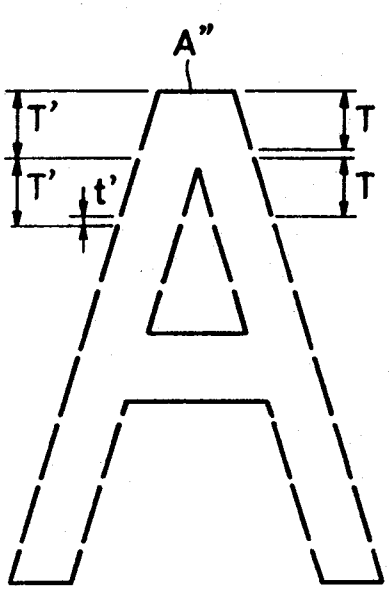
Figure 7:
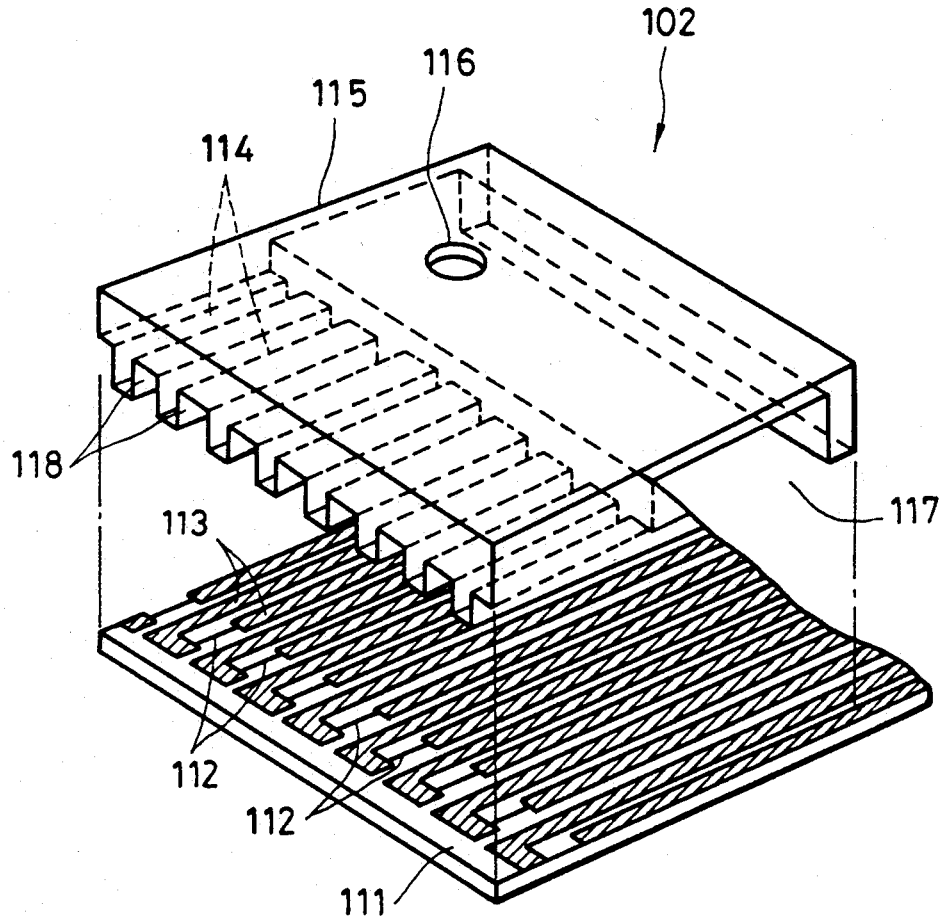
Figure 8A:
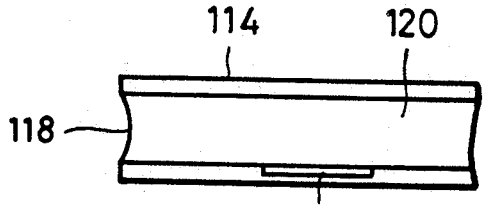
Figure 8B:
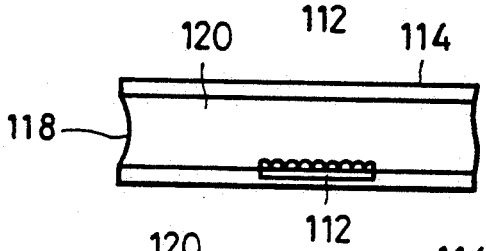
Figure 8C:
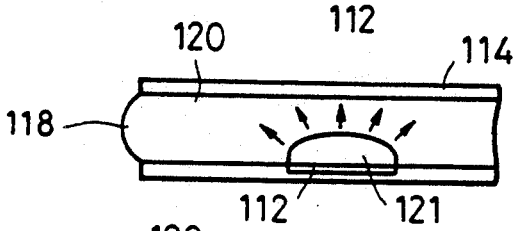
Figure 8D:
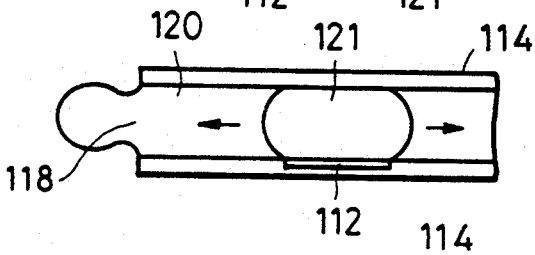
Figure 8E:
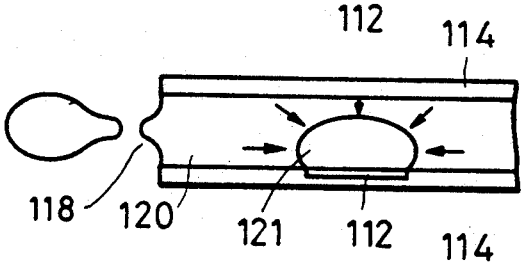
Figure 8F:
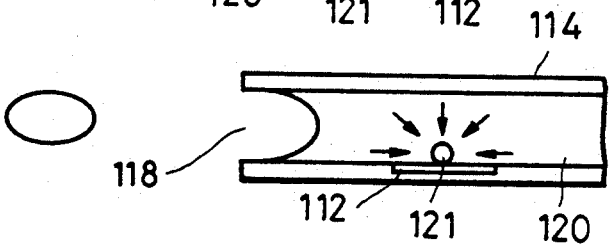
Figure 8G:
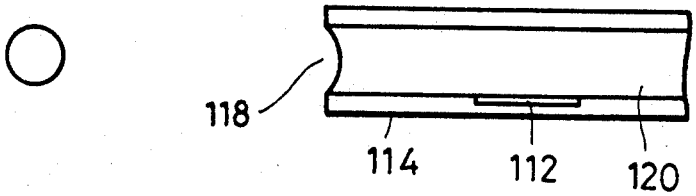

FIGS. 4(1) and (2) sectional side view of the adjacency of the upper feeding roller in explanation of the relationship of feeding force in the embodiment;

FIG. 5 is a graph showing the relationship of feeding force in the embodiment;

FIGS. 6(1) to 6(3) are views showing a clear image in contrast with two imaging failures of the prior art;

FIG. 7 is a view of an ink jet head; and

FIG. 8 is a view showing the principle of the ink jet head.

DETAILED DESCRIPTION OF PREFERRED EMBODIMENT

Figure 1:
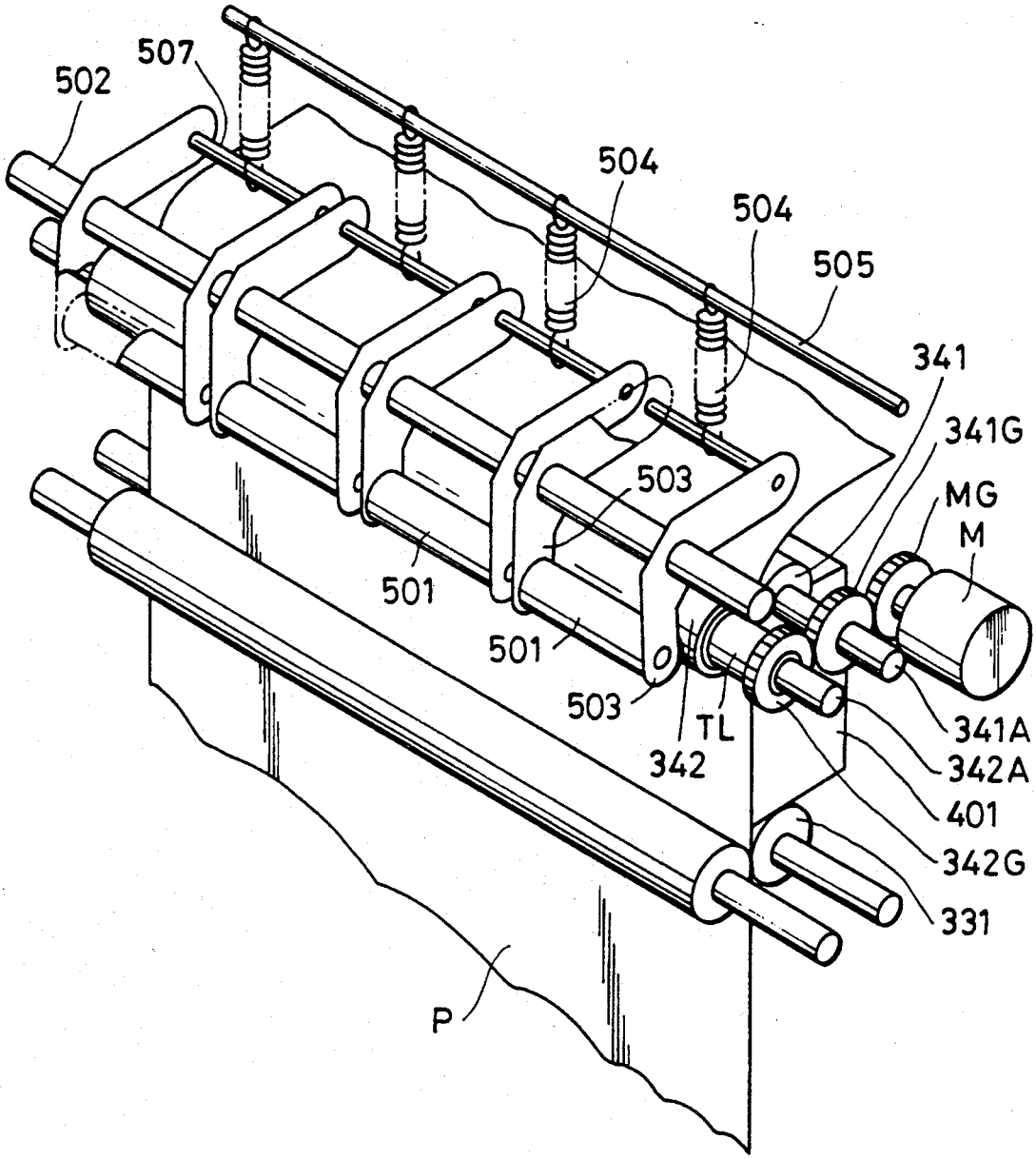
FIG. 1 is a perspective view of an upper feeding roller according to an embodiment of the present invention.

The present invention will now be described according to an embodiment shown in the drawings. FIG. 1 is a perspective view of the adjacency of a platen in an image recording apparatus in accordance with an embodiment of the present invention, and FIG. 2 is a sectional side view of the recording apparatus.

Figure 2:
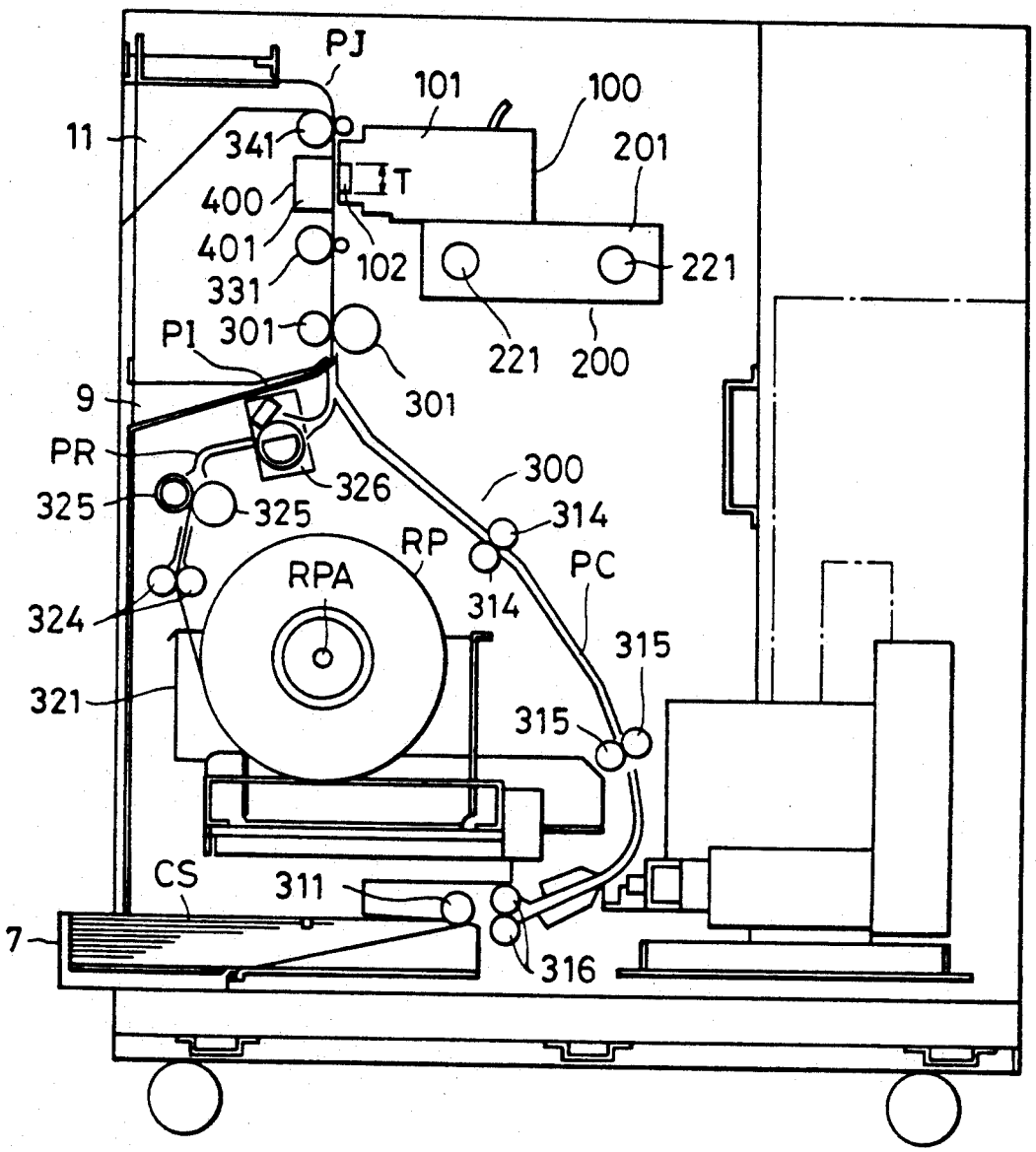
FIG. 2 is a sectional side view of an image recording apparatus to which the present invention is applied.

Referring to FIG. 2, CS designates recording media cut into sheets (for example, recording cut sheets or the like) which are stacked in a cassette 7. RP designates a rolled recording medium which is rotatably mounted on rotation axis RPA. PC, PR and PI designate feed paths for the cut sheets CS, the rolled paper PR and a recording medium inserted from a manual supply inlet 9, respectively, and join near the nip position of feeding rollers 301.

A cut sheet CS, which is separated from the cassette 7 by the co-operation of a pick-up roller 311 and an unillustrated separation member, such as a separation claw, is inserted into the feeding path PC, guided on the feeding path PC while being nipped by pairs of rollers 316, 315 and 314 disposed along the feeding path PC, and led to the feeding rollers 301. A pair of rollers 324 pulls the recording medium from the roll RP and inserts the recording medium into feeding path PR. Rollers 325 convey the recording medium through the feeding path PR toward the feeding rollers 301 by way of a cutter 326 for cutting the rolled paper RP to a predetermined size, which cutter is mounted along the feeding path PR. Numeral 321 denotes a holder for holding the rolled paper RP.

The recording medium passes between feeding rollers 301 via feeding path PC, PR or PI and is led to platen 401 through lower feeding rollers 331, such as resist rollers, disposed upstream of platen 401. When the recording medium reaches platen 401, a recording operation is performed by an ink jet recording head 102. After passing through platen 401 the recording medium is nipped by upper feeding rollers 341 and fed into feeding path PJ whereupon the recording medium is ejected from the recording apparatus through an eject outlet 11.

An ink jet recording station 100 as an image recording means is mounted opposite platen 401. Ink jet head 102 is fixed to a head holder 101 which is fixed to a recording station feeding system 200. A carriage 201 is mounted to convey the head holder 101 across the width of the surface of the paper along rails 221.

In an image recording operation, the recording medium P is held at a fixed position along the platen 401 while ink is jetted from the ink jet head 102 toward the recording medium P according to image signals while carriage 201 is moved across the width of the recording medium P, and an image within the recording width T is recorded onto the recording medium P. The upper feeding rollers 341 are then driven so as to convey the recording medium P by the recording width T. Recording medium P is again held at a fixed position along platen 401 as an image is recorded within the recording width T. Images are recorded onto the recording medium P by repeating this operation.

Ink jet head 102 is a bubble jet head and the construction thereof is shown in FIG. 7.

Referring to an exploded explanatory view shown in FIG. 7, electro-thermal converters (jetting heaters) 112 and electrodes 113, such as aluminum, for supplying to electric power to the electro-thermal converters 112, are deposited as films on the silicon substrate of a heater board 111. A top plate 115 having a partition wall for partitioning paths (nozzles) for recording liquid is adhered to the heater board 111. An ink cartridge for supplying ink to the recording head 102 is exchangeably mounted at a predetermined position in the apparatus.

The ink supplied from the ink cartridge through a conduit is filled from a supply hole 116 formed on the top plate 115 into a common liquid chamber 117 in the recording head 102, and led from the common liquid chamber 117 into each nozzle 114. Ink ejection orifices 118 are formed in the nozzles 114 and arranged in the recording head 102 at a predetermined pitch in the recording medium P feeding direction opposite to the recording medium P.

In this embodiment, recording is executed by jetting the ink from the recording head 102 in synchronization with the movement of the carriage 201.

The recording will be described with reference to FIGS. 8(*a*) to (*g*). As shown in FIG. 8(*a*), the surface tension of ink 120 filled in the nozzle 114 and the external pressure are in equilibrium at the orifice plane in a normal state. In order to jet the ink 120 in this state, electric power is supplied to the electro-thermal converter 112 in the nozzle 114 so as to rapidly raise the temperature of the ink in the nozzle 114 over its nucleate boiling. The ink adjacent to the electro-thermal converter 112 is heated and produces a bubble 121 as shown in FIG. 8(*c*). The ink in nucleate boiling is vaporized and causes film boiling, so that the bubble 121 rapidly grows as shown in FIG. 8(*c*).

When the bubble 121 grows to its maximum size as shown in FIG. 8(*d*), a droplet of the ink is pushed out from the ejection orifice 118 of nozzle 114. When the supply of electric power to the electro-thermal converter 112 stops, the grown bubble 121 cools and is shrunk by the ink 120 in the nozzle 114. The ink droplet is jetted from the ejection orifice 118 by the growth and shrinkage of bubble 121. Furthermore, as the ink 120 comes into contact with the surface of electro-thermal converter 112, the surface of electro-thermal converter 112 is rapidly cooled, as shown in FIG. 8(*f*), and the bubble 121 disappears or shrinks to an almost negligible size. When the bubble 121 shrinks, the ink is supplied from the common liquid chamber 117 into the nozzle 114 by the capillary action as shown in FIG. 8(*g*) and the nozzle 114 prepares for the next supply of electric power thereto.

Therefore, an ink image is recorded on the recording sheet by reciprocating the carriage 201 and supplying electric power to the electro-thermal converter 112 according to image signals in synchronization of the movement of carriage 201.

In the above ink jet recording method, it is preferable to mount a recovery means at both ends of the movement range of the carriage.

The recovery means has a function of preventing the ink adjacent to ejection orifice 118 of the recording head 102 from drying and solidified, thereby covering the ink ejection orifice 118 of the recording head 102. The recovery means includes a pump that is driven so as to absorb ink from the ejection orifice 118 by absorptive force thereof and execute a recovery process in order to recover from jetting failure of the ink, remove the ink or prevent such jetting failure.

The adjacency of the platen 401 will now be described with reference to FIG. 1.

A back-up roller 342 as a second rotator is disposed opposite to the upper feeding roller 341 as a first rotator. Urging rollers 501 are supported by arms 503 supported rotatably on a shaft 502 fixed to the body of apparatus. Arms 503 are interconnected at their upper end by a rod 507. Extension springs 504 are attached to rod 507 at one end with the other ends of extension springs 504 attached to shaft 505 fixed to the body of the apparatus. As a result, the tensile force of the extension springs 504 is transmitted to the urging rollers 501 through arms 503. Furthermore, since urging rollers 501 are urged against back-up roller 342, the nip pressure between back-up roller 342 and upper feeding roller 341 is obtained by the force of extension springs 504. A plurality of urging rollers 501 are arranged in the longitudinal direction of the back-up roller 342. The nip pressure between the back-up roller 342 and the upper feeding roller 341 can be kept uniform longitudinally by setting a proper strength of the springs 504 corresponding to the urging rollers 501, and the recording medium P is stably conveyed.

A motor M is disposed near the platen 401, and a gear MG fixed to the shaft of the motor M engages a gear 341G fixed to a shaft 341A of the upper feeding roller 341. A torque limiter TL is disposed on a shaft 342A of the back-up roller 342, and a gear 342G connected to torque limiter TL engages the gear 341G of shaft 341A of the upper feeding roller 341.

The operation of the torque limiter TL will be described in more detail with reference to FIG. 3.

Figure 3:
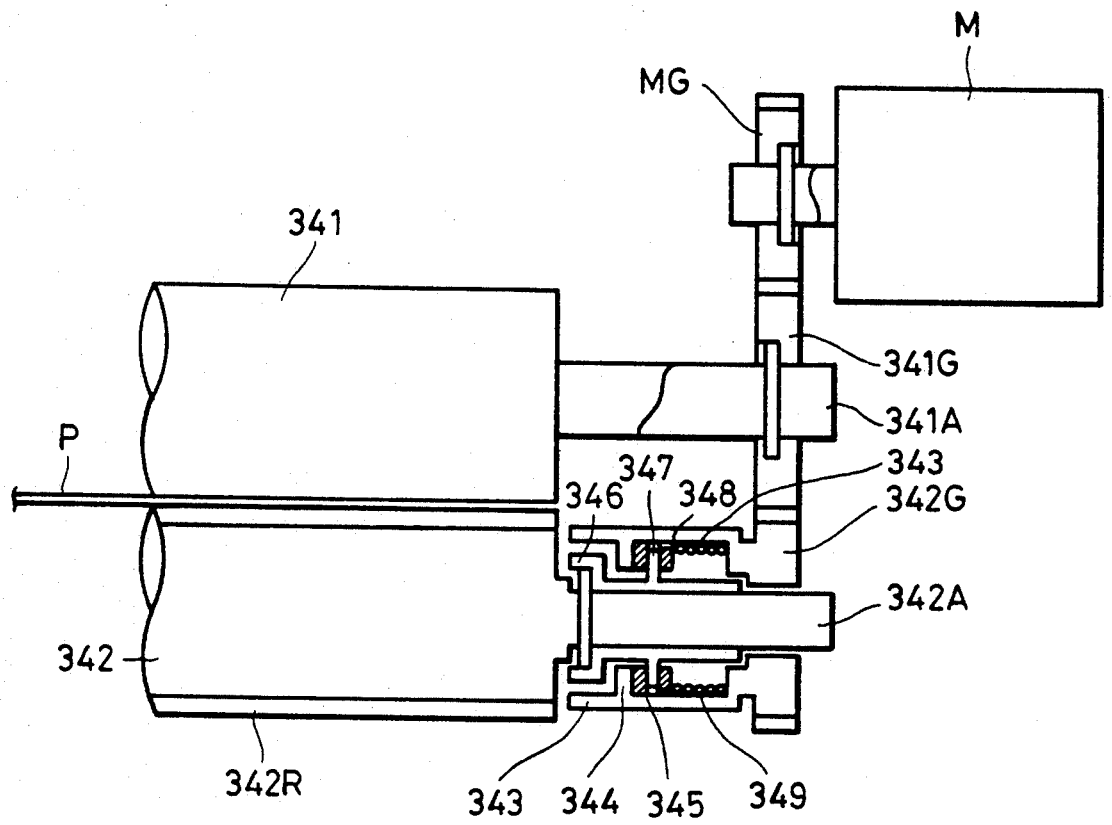
FIG. 3 is a sectional view of the adjacency of a torque limiter according to the embodiment of the present invention.

FIG. 3 is a cross-sectional view of the torque limiter TL according to the embodiment of the present invention.

An outer shell 343 of torque limiter TL is a drive rotator and is integrally formed together with gear 342G. A first slide member 345 is fixed to a projection 344 of the outer shell 343. An inner body 346 of the torque limiter TL is fixed to the shaft 342A of the back-up roller 342, and a projection 347 of the inner body 346 is in contact with the first slide member 345. A second slide member 348 is pressed against projection 347 of inner body 346 by a compression spring 349. The other end of compression spring 349 pushes against outer shell 343 of torque limiter TL. Therefore, projection 347 of the inner body 346 is pressed between the first and second slide members 345 and 348.

When the motor M is driven, the drive force of the motor M is transmitted to the gear 341G through the motor gear MG so as to rotate the upper feeding roller 341. Since the gear 341G and gear 342G engage, the drive force of the motor M is transmitted to the outer shell 343 of torque limiter TL through gear 342G. If the load torque of the back-up roller 342 is small, the drive force is transmitted to the inner body 346 by the friction force between the projection 347 of the inner body 346 of the torque limiter TL and the first and second slide members 345 and 348 so as to drive the back-up roller 342.

If the load torque of the back-up roller 342 is large, projection 347 of the inner body 346 slips between the first and second slide members 345 and 348.

The number of teeth on gear 342G on back-up roller shaft 342A and gear 341G on the upper feeding roller shaft 341A are fixed so that the surface velocity of the back-up roller 342 is a few percent larger than that of the upper feeding roller 341.

A rubber layer 342R having a high coefficient of friction is fixed onto the surface of the back-up roller 342. The surface of the upper feeding roller 341 is metal which increases accuracy, and is processed by sand blasting to enhance its coefficient of friction.

When the motor M is rotated, the drive force of the motor M rotates the upper feeding roller 341 through the gear 341G. Although the drive force transmitted from the gear 342G attempts to rotate the back-up roller 342 at a velocity higher than the surface velocity of the upper feeding roller 341, since the rotation force transmitted from the upper feeding roller 341 through the recording medium P is larger than the slip torque force of the torque limiter TL, the back-up roller 342 is rotated at the same surface velocity as that of the upper feeding roller 341, and a slip is caused between the first and second slip members 345 and 348 of the torque limiter TL and the projection 347 of the inner body 346.

FIGS. 4(1) and 4(2) are sectional views of the upper feeding roller 341 and the back-up roller 342 to explain the relationship of the feeding forces. First, the conditions in which the recording medium P can be conveyed by both the upper feeding roller 341 and the back-up roller 342 will now be described with reference to FIGS. 4(1) and 4(2).

The feeding force applied from the upper feeding roller 341 to the recording medium P is $F_1$, the feeding force applied from the back-up roller 342 to the recording medium P is $F_2$, and the feeding load which the recording medium P receives downstream from the upper feeding roller 341 and back-up roller 342 is $F_3$.

Furthermore, the slip torque of the torque limiter TL is T, and the radius of the back-up roller 342 is R. Since feeding load $F_3$ of the recording medium P may change in relation to the passage of time, the maximum and minimum values of the feeding force are $F_{3MAX}$ and $F_{3MIN}$.

In order to surely convey the recording medium by the upper feeding roller 341 and the back-up roller 342, the minimum value of $F_2=T/R$ is required. The condition in which the recording medium is surely conveyed is:

$$F_1+F_2>F_{3MAX} \quad (1)$$

When $F_1$ is the maximum, that is, when $F_1$ is the maximum value capable of acting on the recording medium from the upper feeding roller 341, the minimum value of $F_2$ meets the above expression (1). If the pressure of the back-up roller 342 against the upper feeding roller 341 is $F_p$ and the coefficient of friction between the back-up roller 342 and the recording P is $\mu_1$, the maximum value of $F_1$ is $\mu_1 F_p$, that is, the maximum coefficient of friction which does not cause a slip between the back-up roller 342 and the recording medium P.

On the other hand, if the slip torque T of the torque limiter TL is too large, the torque limiter does not slip, the back-up roller 342 is rotated at a surface velocity higher than the surface velocity of the upper feeding roller 341, and the recording medium is also conveyed at a high speed. The way in which such a condition is prevented is described with reference to FIG. 4(2). No slip between the recording medium P and the upper feeding roller 341 results when the feeding force $F_2$ from the back-up roller 342 is such that $F_2<\mu_1 F_p+F_{3MIN}$. In other words, if $F_1=\mu_1 F_p$:

$$F_{3MIN}+F_1>F_2 \quad (2)$$

When the coefficient of friction between the back-up roller 342 and the recording medium P is $\mu_2$, $\mu_2>\mu 1$. Therefore, even if the recording medium P causes a slip on the upper feeding roller 341, it does not slip on the back-up roller 342.

The following relationship is valid based on the expressions (1) and (2):

$$F_{3MIN}+F_1>F_2>F_{2MAX}-F_1 \quad (3)$$

FIG. 5 is a graph explaining the relationship among the above expressions (1) to (3). The vertical axis designates $F_2$and the horizontal axis designates $F_1$ (= || $_1F_p$). The area meeting the condition wherein $F_{3MIN}+F_1>F_2$ in expression (1) is below the line representing $F_{3MIN}+F_1=F_2$, and the area meeting the condition wherein $F_2>F_{3MAX}-F_1$ is above the line representing $F_{3MAX}-F_1=F_2$.

Therefore, the range which meets the expression (3) is shaded with slanted lines in FIG. 5.

If $F_1$ is larger than $F_{3MAX}$, it will always be within the shaded region, even if $F_2=0$, since $F_1$ is to the right of the point wherein $F_1=F_{3MAX}$. Therefore, the drive force transmitted by the torque limiter TL may be 0.

However, if $F_1$ is smaller than $F_{3MAX}$, for example, if the feeding force $F_1$ (the maximum possible friction force between the recording medium P and the upper feeding roller 341 under the pressure $F_p$) becomes lower than $F_{3MAX}$ due to the abrasion of the roller and so on, it is necessary that $T>0$ in order to meet the expression (1).

If $F_1$ is lowered, for example, if $F_1=F_{11}$ and $F_2=10$ in FIG. 5, the point (F11, 0) is below the line representing $F_{3MAX}-F_1=F_2$. Therefore, the expression (1) is not satisfied, the recording medium is not conveyed by both the upper feeding roller 341 and the back-up roller 342 and the recording medium slips.

If a feeding force larger than the feeding force corresponding to $F_{21}$ in FIG. 5 is applied to the back-up roller 342, the feeding force is within the shaded range, and the recording medium can be conveyed without slipping. In this case, since $F_{21}=F_{3MAX}-F_{11}$, the recording medium can be conveyed without slipping if:

$$F_2>F_{21}(=F_{3MAX}-F_{11}) \quad (4)$$

On the other hand, if the force of the torque limiter is increased and $F_2$ exceeds $F_{22}$, $F_2$ is above the line representing $F_{3MIN}+F_1=F_2$ and is outside the shaded range.

Therefore, $F_2$ is too large and the recording medium is conveyed by $F_2$ against the resultant force of $F_1$ and $F_{3MIN}$shown in FIG. 4(2).

In order to prevent such conveyance, the feeding speed of the recording medium corresponds to the peripheral speed of the upper feeding roller 341 and the recording medium is conveyed by a predetermined amount if:

$$F_2<F_{22}(=F_{3MIN}+F_{11}) \quad (5)$$

Thus, even if the feeding force $F_1$ is small, it is possible to maintain a predetermined feeding amount of the recording medium by setting the torque T of the torque limiter TL according to the expressions (4) and (5) so that $F_{22}>F_2>F_{21}$.

As described above, it is only necessary to set the torque of the torque limiter so that the relationship between the $F_1$ and $F_2$ is within the shaded range shown in FIG. 5.

Since $$F2=\frac{T}{R}$$

in the expression (3), the expression (3) can be changed as follows:

$$R(F_{3MIN}+F_1)>T>R(F_{3MAX}-F_1) \quad (6)$$

Since $F_1=\mu_1 F_p$:

$$R(F_{3MIN}+\mu_1 F_p)>T>R(F_{3MAX}-\mu 1 F_p) \quad (7)$$

Therefore, it is possible to convey the recording medium by a predetermined amount by setting the torque T of the torque limiter TL at a value to meet the expression (7).

Since the torque limiter TL described in this embodiment is inexpensive and highly precise, there is no problem in the use thereof.

As described above, it is possible to maintain a constant feeding amount of a recording medium by using the present invention.

Furthermore, when a metallic roller which can increase accuracy is used as a roller for defining the feeding amount of the recording medium, a large feeding force equivalent to that in the use of an elastic roller, such as a rubber roller, can be obtained. Thus, it is possible to achieve conveyance of a recording medium having high precision and reliability and a large feeding force.

If a change in the feeding load $F_3$ is small, $F_3=F_{3MAX}$ and $F_3=F_{3MIN}$.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet conveyor apparatus, comprising:

a first rotator for supplying a feeding force to a sheet by rotating while in contact with a front surface of the sheet;

a second rotator, arranged in opposing relation to said first rotator to form a nip therewith, for supplying a feeding force to the sheet while in contact with a back surface of the sheet;

a drive rotator rotatable by a drive force of a drive source; and drive transmission means for transmitting the drive force of said drive rotator to said first and second rotators, said drive transmission means comprising means for rotating said second rotator at a peripheral velocity higher than that of said first rotator, and means associated with said drive transmission means for allowing a slip between said first and second rotators sufficient to permit a peripheral velocity of said second rotator to conform to a speed of the sheet when the sheet is being conveyed.

2. A sheet conveyor apparatus according to claim 1, wherein said drive transmission means transmits the drive force between said drive rotator and said second rotator at least in part by friction force.

3. A sheet conveyor apparatus according to claim 2, wherein said drive transmission means includes a first friction member at an end of said second rotator which integrally rotates with said second rotator and a second friction member at an end of the drive rotator which integrally rotates with said drive rotator, the drive force transmitting by putting said first and second friction members into contact with each other.

4. A sheet conveyor apparatus according to claim 3, wherein said second friction member rotates at a higher velocity than said first friction member, and a slip is caused between said first and second friction members when the sheet is being conveyed by said first and second rotators.

5. A sheet conveyor apparatus according to claim 1, wherein said first rotator includes a peripheral surface that is made of a material having a hardness greater than that of the peripheral surface of said second rotator.

6. A sheet conveyor apparatus according to claim 5, wherein the peripheral surface of said first rotator is a metal and the peripheral surface of said second rotator is a rubber.

7. A sheet conveyor apparatus according to claim 6, further comprising recording means for recording an image on the sheet conveyed by said first and second rotators.

8. A sheet conveyor apparatus according to claim 7, wherein said recording means includes an ink jet head for jetting ink.

9. A sheet conveyor apparatus according to claim 8, wherein said ink jet head forms the image by ink droplets formed by heat energy.

10. A sheet conveyor apparatus according to claim 1, wherein when a coefficient of friction between the sheet and said first rotator is $\mu_1$, a pressure between the sheet and said first rotator is $F_p$, a load for conveying the sheet is $F_3$ and a radius of said second rotator is R, a torque T which said drive transmission means transmits while causing a slip satisfies the following range:

$$T>R(F_3+\mu_1F_p)$$

11. A sheet conveyor apparatus, comprising:

a first rotator for supplying a feeding force to a sheet by rotating in contact with the sheet;

a second rotator, arranged in opposing relation to said first rotator to form a nip therewith, for supplying a feeding force to the sheet while in contact with the sheet from an opposite side of said sheet as said first rotator;

a drive rotator rotatable by a drive force of a drive source; and a torque limiter for transmitting at least a portion of the rotation of said drive rotator to said second rotator, slipping between said drive rotator and said second rotator, so that said second rotator rotates at a peripheral velocity corresponding to a speed of the sheet when the sheet is being conveyed.

12. A sheet conveyor apparatus according to claim 11, including means for rotating said second rotator at a peripheral velocity higher than that of said first rotator, and wherein said torque limiter transmits the drive force of said drive rotator to said second rotator while causing a slip on said drive rotator to allow the peripheral velocity of the second rotator to correspond with the sheet feeding speed.

13. A sheet conveyor apparatus according to claim 12, wherein when a coefficient of friction between the sheet and said first rotator is $\mu_1$, a pressure between the sheet and said first rotator is $F_p$, a load for conveying the sheet if $F_3$ and a radius of said second rotator is R, a torque T which said torque limiter transmits while causing a slip satisfies the following range:

$$T<R(F_3+\mu_1F_p)$$

14. An image recording apparatus, comprising:

a first rotator for supplying a feeding force to a sheet by rotating while in contact with a front surface of the sheet;

a second rotator, arranged in opposing relation to said first rotator to form a nip therewith, for supplying a feeding force to the sheet while in contact with a back surface of the sheet;

a drive rotator rotatable by a drive force of a drive source;

drive transmission means for transmitting the drive force of said drive rotator to said first and second rotators, said drive transmission means comprising means for rotating said second rotator at a peripheral velocity higher than that of said first rotator, and means associated with said drive transmission means for allowing a slip between said first and second rotators sufficient to permit a peripheral velocity of said second rotator to conform to a speed of the sheet when the sheet is being conveyed; and recording means for recording an image on the sheet conveyed by said first and second rotators.

15. An image recording apparatus according to claim 14, wherein said recording means includes an ink jet head for jetting ink.

16. An image recording apparatus according to claim 15, wherein said ink jet head forms the image by ink droplets formed by heat energy.

17. An image recording apparatus, comprising:

a first rotator for supplying a feeding force to a sheet by rotating while in contact with the sheet;

a second rotator, arranged in opposing relation to said first rotator to form a nip therewith, for supplying a feeding force to the sheet while in contact with the sheet from an opposite side of the sheet as said first rotator;

a drive rotator rotatable by a drive force of a drive source; and a torque limiter for transmitting at least a portion of the rotation of said drive rotator to said second rotator, slipping between said drive rotator and said second rotator, so that said second rotator rotates at a peripheral velocity corresponding to a speed of the sheet when the sheet is being conveyed; and recording means for recording an image on the sheet conveyed by said first and second rotators.

18. An image recording apparatus according to claim 17, wherein said recording means includes an ink jet head for jetting ink.

19. An image recording apparatus according to claim 18, wherein said ink jet head forms the image by ink droplets formed by heat energy.

20. A sheet conveyor apparatus, comprising:

drive means for generating a driving force;

a first rotator, driven by the driving force of said drive means, for supplying a feeding force to a sheet by rotating while in contact with a front surface of the sheet;

a second rotator, arranged in opposing relation to said first rotator to form a nip therewith, for supplying a feeding force to the sheet while in contact with a back surface of the sheet; and drive transmission means for transmitting the drive force of said drive means to said second rotator so as to rotate said second rotator at a peripheral velocity different from that of said first rotator while allowing a slip between said drive means and said second rotator sufficient to permit a peripheral velocity of said second rotator to conform to a speed of the sheet when the sheet is being conveyed.

21. A sheet conveyor apparatus according to claim 20, wherein said drive transmission means transmits the drive force between said drive rotator and said second rotator at least in part by friction force.

22. A sheet conveyor apparatus according to claim 21, wherein said drive transmission means includes a first friction member at an end of said second rotator which integrally rotates with said second rotator and a second friction member at an end of the drive rotator which integrally rotates with said drive rotator, the drive force transmitting by putting said first and second friction members into contact with each other.

23. A sheet conveyor apparatus according to claim 22, wherein said second friction member rotates at a higher velocity than said first friction member, and a lip is caused between said first and second friction members when the sheet is being conveyed by said first and second rotators.

24. A sheet conveyor apparatus according to claim 20, wherein the peripheral surface of said first rotator is made of a material having a hardness greater than that of the peripheral surface of said second rotator.

25. A sheet conveyor apparatus according to claim 24, wherein the peripheral surface of said first rotator is a metal and the peripheral surface of said second rotator is a rubber.

26. A sheet conveyor apparatus according to claim 25, further comprising recording means for recording an image on the sheet conveyed by said first and second rotators.

27. A sheet conveyor apparatus according to claim 26, wherein said seconding means includes an ink jet head for jetting ink.

28. A sheet conveyor apparatus according to claim 27, wherein said ink jet head forms the image by ink droplets formed by heat energy.

29. A sheet conveyor apparatus according to claim 20, wherein when a coefficient of friction between the sheet and said first rotator is $\mu 1$, a pressure between the sheet and said first rotator is $F_p$, a load for conveying the sheet is $F_3$ and a radius of said second rotator is R, a torque T which said drive transmission means transmits while causing a slip satisfies the following range:

$$T > R(R_3 + \mu_1 F_p).$$

* * * * *

UNITED STATES PATENT AND TRADEMARK OFFICE

CERTIFICATE OF CORRECTION

PATENT NO. 5,241,331

DATED August 31, 1993

INVENTOR(S) Kazuyoshi CHIKU

It is certified that error appears in the above-indentified patent and that said Letters Patent is hereby corrected as shown below:

Column 4

Line 36, "to" should be deleted.

Column 5

Line 29, "solidified," should read --solidifying,--.

Column 7

Line 51, "$F_2$and" should read --$F_2$ and-- and, "$F_1(=\|_1F_p)$." should read --$F_1(=\mu_1F_p)$.--, Line 53, "expression 1" should read --expression 3--.

Column 8

Line 3, "$F_2$=10" should read --$F_2$=0--.

Column 10

Line 12, "$T>R(F_3+\mu_1F_p)$ should read --$T<R(F_3+\mu_1F_p)$--,

Line 44, "if" should read --is--.

UNITED STATES PATENT AND TRADEMARK OFFICE

CERTIFICATE OF CORRECTION

PATENT NO. : 5,241,331

DATED : August 31, 1993

INVENTOR(S) : Kazuyoshi Chiku

It is certified that error appears in the above-indentified patent and that said Letters Patent is hereby corrected as shown below:

Column 12

Line 18, "lip" should read --slip--,

Line 48, "$T>R(R_3+\mu_1F_p)$." should read --$T<R(F_3+\mu_1F_p)$.--.

Signed and Sealed this

Nineteenth Day of April, 1994

*Attest:*

*Attesting Officer*

BRUCE LEHMAN

*Commissioner of Patents and Trademarks*